US007704015B2

(12) United States Patent
Toth

(10) Patent No.: US 7,704,015 B2
(45) Date of Patent: Apr. 27, 2010

(54) EXPANDABLE AIR BAG CONSTRUCTION FOR PROTECTION OF AN INFLATABLE AIR CELL IN A DIVER'S BUOYANCY COMPENSATOR

(76) Inventor: Douglas J. Toth, 16742 Burke La., Huntington Beach, CA (US) 92647

( * ) Notice: Subject to any disclaimer, the term of this patent is extended or adjusted under 35 U.S.C. 154(b) by 0 days.

(21) Appl. No.: 12/077,232

(22) Filed: Mar. 17, 2008

(65) Prior Publication Data

US 2009/0232604 A1 Sep. 17, 2009

(51) Int. Cl.
*B63C 11/02* (2006.01)
*B63C 9/08* (2006.01)
*B65D 30/20* (2006.01)
*B65D 30/22* (2006.01)

(52) U.S. Cl. ..... 405/186; 441/88; 441/114; 383/3; 383/109; 383/118; 383/120

(58) Field of Classification Search ..... 405/185, 405/186; 441/80, 88, 101, 113, 114; 220/560.01; 383/2, 3, 109, 112, 118, 120
See application file for complete search history.

(56) References Cited

U.S. PATENT DOCUMENTS

| | | | | | |
|---|---|---|---|---|---|
| 254,580 | A * | 3/1882 | Willard | ..... | 441/108 |
| 3,042,796 | A * | 7/1962 | De Forest | ..... | 362/158 |
| 4,523,914 | A * | 6/1985 | Faulconer et al. | ..... | 441/108 |
| 4,561,853 | A * | 12/1985 | Faulconer et al. | ..... | 441/106 |
| 4,810,134 | A * | 3/1989 | Faulconer et al. | ..... | 405/186 |
| 4,952,095 | A * | 8/1990 | Walters | ..... | 405/186 |
| 5,011,334 | A * | 4/1991 | Vorhauer | ..... | 405/186 |
| 5,385,496 | A * | 1/1995 | Seligman | ..... | 441/115 |
| 5,522,679 | A * | 6/1996 | Eungard | ..... | 405/186 |
| 5,599,219 | A * | 2/1997 | Green | ..... | 441/106 |
| 5,707,177 | A * | 1/1998 | Lehrer et al. | ..... | 405/186 |
| 6,244,784 | B1 * | 6/2001 | Gordon | ..... | 405/186 |
| 6,592,298 | B2 * | 7/2003 | Beltrani | ..... | 405/186 |
| 6,659,689 | B1 * | 12/2003 | Courtney et al. | ..... | 405/186 |
| 6,805,519 | B1 * | 10/2004 | Courtney | ..... | 405/185 |
| 7,052,211 | B1 * | 5/2006 | Curry | ..... | 405/186 |
| 7,328,669 | B2 * | 2/2008 | Adams | ..... | 114/315 |
| 2002/0057946 | A1 * | 5/2002 | Beltrani | ..... | 405/186 |
| 2008/0019777 | A1 * | 1/2008 | Carney | ..... | 405/186 |
| 2009/0232604 | A1 * | 9/2009 | Toth | ..... | 405/186 |

* cited by examiner

*Primary Examiner*—Tara Mayo-Pinnock
(74) *Attorney, Agent, or Firm*—Leonard Tachner

(57) ABSTRACT

In an air cell of a buoyancy compensator an outer protective bag has a section of double layer construction. In the double layer area, two panels of elastic material are each juxtaposed adjacent a panel of non-elastomeric material. The elastic panels are spaced at a distance of each other such that during expansion when the elastic panels are at their limit, there is still an adjacent layer of non-elastomeric protective material. If a sharp object penetrates the elastic panel, it will not puncture the inner air cell unless it can also pierce the protective bag non-elastic layer.

3 Claims, 3 Drawing Sheets

EXPANDABLE AIR BAG CONSTRUCTION FOR PROTECTION OF AN INFLATABLE AIR CELL IN A DIVER'S BUOYANCY COMPENSATOR

BACKGROUND OF THE INVENTION

1. Field of the Invention

The present invention relates generally to the field of scuba diving equipment and more specifically to buoyancy compensators commonly referred to as "BC's".

2. Background Art

In a diver's buoyancy compensator it is desirable to have the most lift (expanded volume) possible when needed yet have the least amount of bulk when it is deflated. Typically the compensator is used in a deflated or near deflated condition unless positive buoyancy is desired on the surface. The bulkier the device, the more hydrodynamic swimming resistance is created.

There are two common types of buoyancy compensator construction. The first may be referred to as a "single bag construction". Single bag buoyancy compensators are those in which there is a single air holding cell exposed directly to the surrounding environment. The materials must be puncture resistant and very durable. Typically they have no expansive or elastomeric properties. There is one company that has a slightly expansive material, but it is expensive and of modest performance. The second type is referred to as "double bag construction". In this configuration, an elastomeric (rubber or polyurethane) air cell is contained within an outer protective shell. By nature, elastomeric materials capable of holding air are not terribly puncture resistant or durable enough to be used without an exterior protective cover, much like an old tube type tire.

U.S. Pat. No. 5,385,496 discloses a BC having an inflatable air cell or bladder.

FIGS. 1a and 1b show the deflated and expanded cross sections of typical "single bag construction" prior art BC's with multiple non-expansive panels. Multiple panels allow the design of a more "three-dimensional shape". FIG. 2 shows the same construction method with only two non-expansive panels.

Prior art double bag construction BC's that utilize rubber or elastomeric air cells that expand and contract are contained in a protective outer shell that usually does not expand. In some instances, a panel of expandable fabric has been incorporated in the outer shell to allow expansion, but those elastic materials are soft, of coarse weave and offer little puncture resistance. This subjects the inner air cell to damage if the outer shell is punctured through the elastic fabric panel. Prior art shows an inner expandable air cell of rubber or elastomeric material. It is enclosed in an outer shell, typically of nylon fabric. Side panels of elastic fabric mesh are sewn to the nylon shell such that the outer shell has the ability to expand during inflation. When inflated, there is considerable exposed surface area of the elastic mesh panel subject to puncture. The weave of the mesh is also at its coarsest condition during expansion, offering little resistance to puncture by sharp objects. This subjects the inner air cell to puncture, since it is not protected by the more durable nylon fabric used in the majority of the outer shell construction.

SUMMARY OF THE INVENTION

In the present invention an air cell of a buoyancy compensator is protected by an outer protective bag which has a section of double layer construction. In the double layer area, two panels of elastic fabric are each juxtaposed adjacent a panel of non-elastomeric material. The elastic panels are spaced at a distance of each other such that during expansion when the elastic panels are at their limit, there is still an adjacent layer of non-elastomeric protective material. If a sharp object penetrates the elastic panel, it will not puncture the inner air cell unless it can also pierce the protective bag layer. This unique construction permits the outer protective bag to expand with inflation of the air cell, but in a way which reduces the risk that an external object can pierce the air cell since there is no straight line path that penetrates only elastic material.

BRIEF DESCRIPTION OF THE DRAWINGS

The aforementioned objects and advantages of the present invention, as well as additional objects and advantages thereof, will be more fully understood herein after as a result of a detailed description of a preferred embodiment when taken in conjunction with the following drawings in which.

DETAILED DESCRIPTION OF A PREFERRED EMBODIMENT

Figure 1:
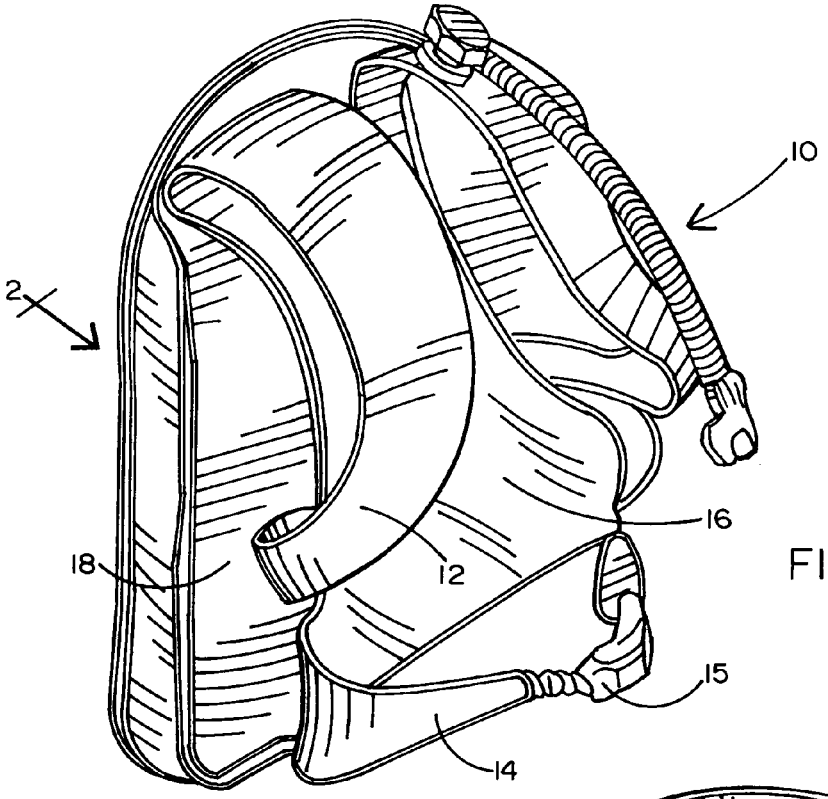
FIG. 1 is an isometric view of a buoyancy compensator having an expandable air bag in accordance with a preferred embodiment of the present invention.
Figure 2:
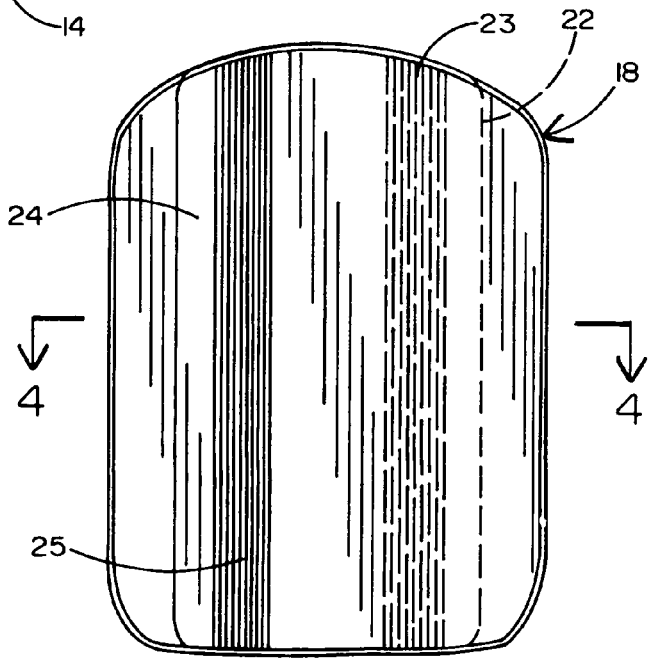
FIG. 2 is a cross-sectional rearview of the air bag taken along line 2 of FIG. 1 with the interior air cell deflated.
Figure 3:
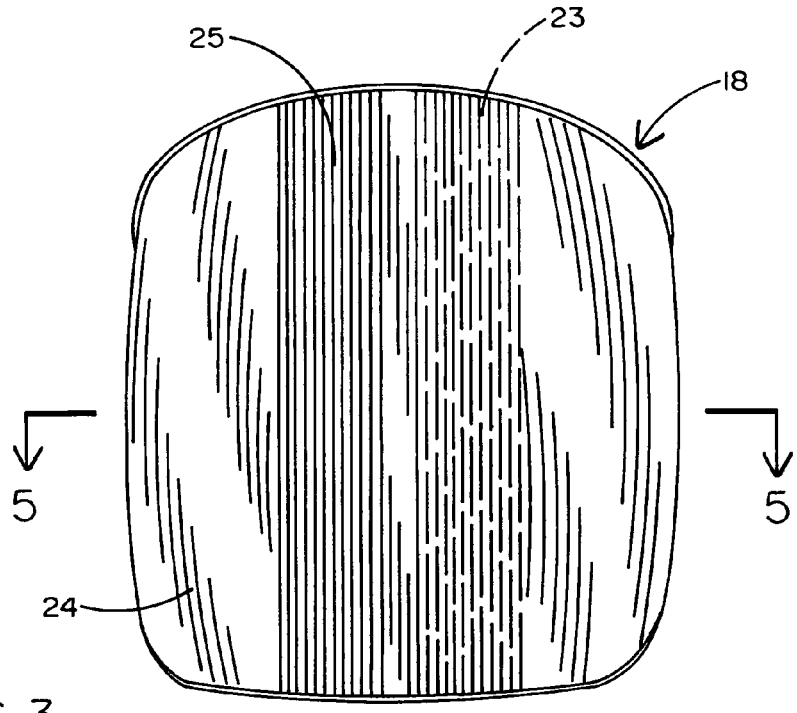
FIG. 3 is a cross-sectional view similar to FIG. 2, but with the interior air cell inflated.
Figure 4:
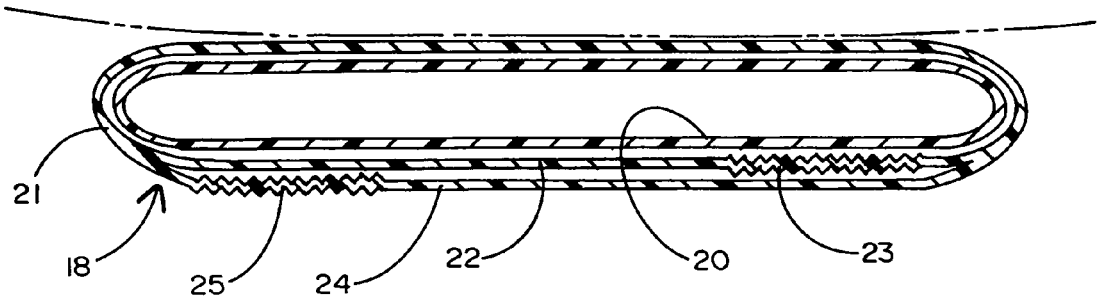
FIG. 4 is a cross-sectional view taken along lines 4-4 of FIG. 2 with the air bag including the interior air cell deflated.
Figure 5:
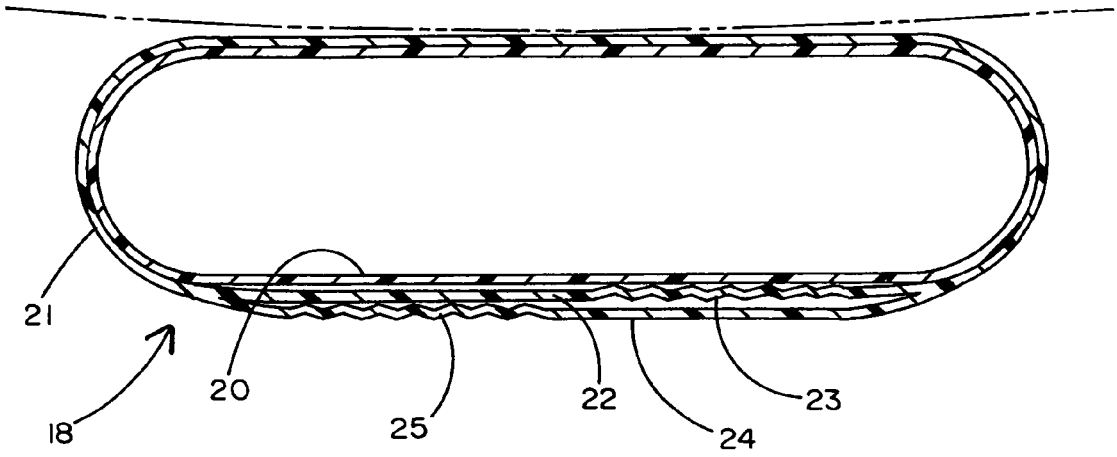
FIG. 5 is a cross-sectional view similar to that of FIG. 4 with the air bag and interior air cell inflated.

Referring now to the accompanying drawings, it will be seen that in FIG. 1 there is shown a BC 10 having an illustrative structure. By way of example, BC 10 has a vest 12, a cummerbund 14 secured by a buckle 15, a back surface 16 and a buoyancy air bag 18.

As seen best in FIGS. 2 through 5, air bag 18 comprises an inner air cell 20 completely surrounded by an outer protective bag 21. On one elongated surface of protective bag 21, the surface is split into a double layer formed by a first outer layer 22 and a second outer layer 24. First outer layer 22 has a first elastic panel 23 and second outer layer 24 has a second elastic panel 25.

First elastic panel 23 and second elastic panel 25 enable a commensurate expansion of outer protective bag 21 with inflation of inner air cell 20 as shown best in FIG*s*. 4 and 5. The unique double layer formed by first outer layer 22 and second outer layer 24 permits each such elastic panel to be positioned either in front of or behind a juxtaposed segment of non-elastic material on the adjacent outer layer. Thus, even though the outer protective bag 21 can expand with the air cell 20, the air cell still is well protected from puncture because in order for penetration of either elastic panel all the way into the air cell, a juxtaposed non-elastic segment must also be penetrated.

Thus, the present invention provides a unique capability in an air bag of a buoyancy compensator by protecting an inflatable air cell within an expandable protective bag that is configured to expand with the air cell while still preventing puncture penetration into the air cell. This unique capability is achieved by employing a novel double layer implementation along at least the outer surface of the air bag where each such layer has an expandable panel juxtaposed with an adjacent puncture resistant non-expansive panel both before and after air cell inflation.

Those having skill in the art of BC's will now perceive various additions and modifications to the illustrated embodiment. Accordingly, the scope hereof is to be limited only by the appended claims and their equivalents.

I claim:

1. In a buoyancy compensator, an inflatable air bag comprising:

an expandable air cell entirely enclosed in a protective outer bag, said outer bag having at least one surface at risk for puncture penetration, said one surface having a pair of coextensive overlapping layers, each said overlapping layer having a first expandable panel to permit expansion of said protective outer bag with inflation of said air cell and a second non-expandable panel;

each said expandable panel of an overlapping layer being juxtaposed with an adjacent non-expandable panel of the other overlapping layer to resist puncture penetration entirely through said protective outer bag, while both of said overlapping layers can expand with inflation of said air cell.

2. In a buoyancy compensator used by scuba divers, an inflatable air bag comprising:

an expandable air cell enclosed within an expandable protective outer material, at least a portion of said outer material being formed of a pair of overlapped material layers, each such overlapped material layers having both non-expandable portions and corresponding expandable panels, each said expandable panel of an overlapped material layer being juxtaposed with an adjacent non-expandable portion of the other overlapping material layer to resist puncture penetration to said air cell while permitting expansion of both said layers with inflation of said air cell.

3. An air bag for a buoyancy compensator comprising:

an inflatable air cell configured to expand in response to entry of pressurized air to increase the buoyancy of the buoyancy compensator;

a protective bag enclosing said air cell, said bag having at least one surface which may be exposed to a risk of penetration by puncture, said at least one surface having two adjacent layers each having both an elastic material and a non- elastic material in separate panels;

the elastic material panel of each such layer being juxtaposed to a non- elastic material panel of the other such layer so that there is no straight line path through said at least one surface to said air cell which can penetrate only elastic material while allowing both of said adjacent layers to expand with inflation of said air cell.

* * * * *